United States Patent [19]

Sato et al.

[11] 4,297,195

[45] Oct. 27, 1981

[54] ELECTRODE FOR USE IN ELECTROLYSIS AND PROCESS FOR PRODUCTION THEREOF

[75] Inventors: Hideo Sato, Chiba; Takayuki Shimamune, Ichihara, both of Japan

[73] Assignee: Permelec Electrode Ltd., Tokyo, Japan

[21] Appl. No.: 77,224

[22] Filed: Sep. 20, 1979

[30] Foreign Application Priority Data

Sep. 22, 1978 [JP] Japan ..... 53-115894

[51] Int. Cl.[3] ..... C25B 11/08

[52] U.S. Cl. ..... 204/290 F; 204/290 R

[58] Field of Search ..... 204/290 R, 290 F

[56] References Cited

U.S. PATENT DOCUMENTS

| | | | |
|---|---|---|---|
| 3,632,498 | 1/1972 | Beer | 204/290 F |
| 3,684,543 | 8/1972 | De Nora et al. | 204/290 FX |
| 3,778,307 | 12/1973 | Beer | 427/126 |
| 3,951,766 | 4/1976 | Cook | 204/98 |
| 4,061,558 | 12/1977 | Saito et al. | 204/290 F |

FOREIGN PATENT DOCUMENTS

| | | | |
|---|---|---|---|
| 2342663 | 3/1975 | Fed. Rep. of Germany | 204/290 F |

*Primary Examiner*—F. C. Edmundson

*Attorney, Agent, or Firm*—Sughrue, Rothwell, Mion, Zinn and Macpeak

[57] ABSTRACT

An electrode for use in the electrolysis of an aqueous solution of a metal halide, the electrode comprising an electrically conductive substrate and, formed thereon, a coating comprising (1) 50 to 95 mole % of platinum and (2)(a) 5 to 50 mole % of tin oxide, or (b) 5 to 50 mole % of tin oxide and cobalt oxide, wherein the tin oxide is present in an amount of at least 5 mole % and the cobalt oxide is present in an amount up to 20 mole %;

and a process for producing the above-described electrode.

2 Claims, 1 Drawing Figure

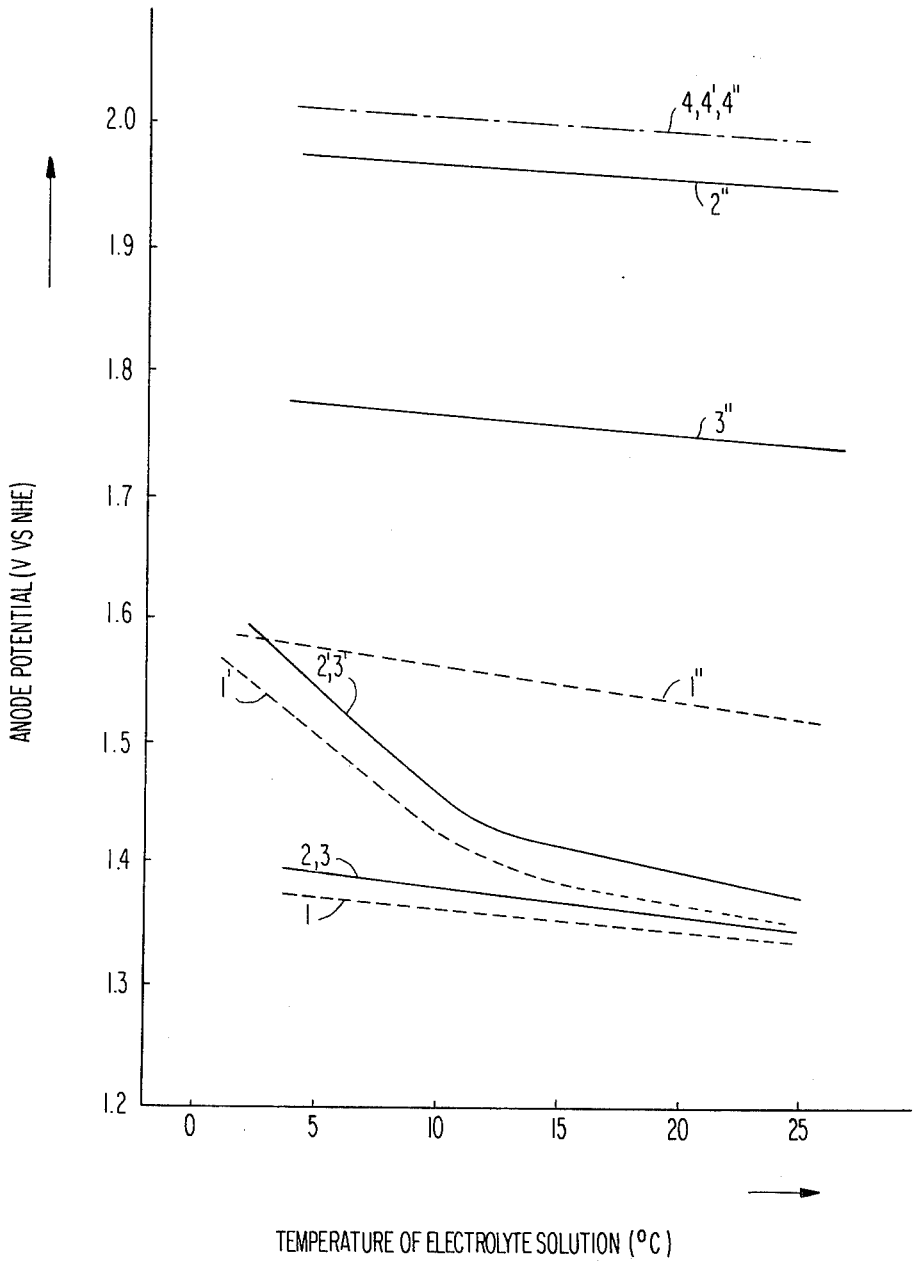
ANODE POTENTIAL (V VS NHE)
2.0
1.9
1.8
1.7
1.6
1.5
1.4
1.3
1.2
0
5
10
15
20
25
TEMPERATURE OF ELECTROLYTE SOLUTION (°C)
4,4',4"
2"
3"
2',3'
1'
1"
2,3
1

ELECTRODE FOR USE IN ELECTROLYSIS AND PROCESS FOR PRODUCTION THEREOF

BACKGROUND OF THE INVENTION

1. Field of the Invention

This invention relates to an electrode for use in the electrolysis of aqueous solutions of metal halides, etc., especially an electrode suitable for the electrolysis of alkali metal halide solutions of low concentrations and at low temperatures, such as sea water, and to a process for producing the electrode.

2. Description of the Prior Art

An electrolysis device for electrolyzing a dilute salt solution such as sea water to generate chlorine at the anode has previously been used, for example, for preventing adhesion of organisms to underwater structures or for water treatment in swimming pools, city water facilities, and sewage systems. In such an electrolysis, chlorine is usually generated at the anode by using a diaphragm-free electrolysis device, and hypochlorite ion is formed by reaction of chlorine with hydroxyl ion. The product is employed for sterilization, bleaching, etc, in the uses described above. Since such an electrolysis device must be operated continuously for long periods of time with good efficiency and stability, the anode must have an especially high durability while retaining the desired electrode characteristics.

In the electrolysis of sea water or the like, the electrolysis conditions such as the concentration or the temperature of the electrolyte are not constant unlike the case of electrolysis of an aqueous solution of sodium chloride at a relatively high temperature and concentration to produce chlorine and alkali. Furthermore, the temperature of the sea water sometimes decreases to below about 20° C. depending upon natural conditions, the sodium chloride concentration in the brine is usually as low as about 3% by weight, and moreover, a large amount of impurities are dissolved in the brine. Accordingly, electrodes used in this electrolysis should meet various requirements under these conditions, for example, a sufficiently high efficiency for chlorine generation and a sufficiently high durability.

Heretofore, metallic electrodes made by plating a corrosion-resistant substrate with platinum or an alloy of a platinum-group metal are known as electrodes for use in electrolyzing sea water or the like. However, since these electrodes have a relatively high rate of consumption, the thickness of the coating must be increased and the cost of the electrode becomes very high. Furthermore, such electrodes do not have satisfactory electrochemical properties. In electrolysis, the chlorine evolution potential is high, and is scarcely different from the oxygen evolution potential. Accordingly, these electrodes have the defect that the current efficiency is low, and the electrolysis voltage during operation is high.

Various electrodes composed of a corrosion-resistant substrate such as titanium and an electrode coating consisting mainly of an oxide of a platinum group metal, such as ruthenium, are also known as electrodes for use in electrolyzing an aqueous solution of a metal halide such as sodium chloride (for example, as disclosed in U.S. Pat. No. 3,711,385 corresponding to Japanese Patent Publication No. 3954/73). These conventional electrodes, however, do not have entirely satisfactory characteristics for use at low temperatures and low electrolyte concentrations, for example, in the electrolysis of sea water or the like.

SUMMARY OF THE INVENTION

An object of this invention is to solve the problems described above and to provide an electrode for use in electrolysis having a high current efficiency and superior durability not only in the electrolysis of an aqueous solution of a metal halide at a high temperature and a high concentration, but also in the electrolysis of an aqueous solution of a metal halide at a low temperature and a low concentration, and a process for producing the electrode.

Accordingly, this invention in one embodiment provides an electrode comprising an electrically conductive substrate and, formed thereon, a coating comprising (1) 50 to 95 mole % of platinum, and (2)(a) 5 to 50 mole % of tin oxide, or (b) 5 to 50 mole % of tin oxide and cobalt oxide, wherein the tin oxide is present in an amount of at least 5 mole % and the cobalt oxide is present in an amount up to 20 mole %.

This invention also in another embodiment provides a process for producing an electrode for use in the electrolysis of an aqueous solution of a metal halide, which comprises applying a coating solution containing a platinum compound and a tin compound, and optionally, a cobalt compound to an electrically conductive substrate, and heat-treating the coated substrate in an oxidizing atmosphere to form on the electrically conductive substrate a coating comprising (1) 50 to 90 mole % of platinum, (2)(a) 5 to 50 mole % of tin oxide, or (b) 5 to 50 mole % of tin oxide and cobalt oxide, wherein the tin oxide is present in an amount of at least 5 mole % and the cobalt oxide is present in an amount up to 20 mole %.

BRIEF DESCRIPTION OF THE ACCOMPANYING DRAWING

The FIGURE is a graphical representation showing variations in the anode potential of the electrodes of this invention in comparison with conventional electrodes, which characteristically depend on the temperature and concentration of the electrolyte solution.

DETAILED DESCRIPTION OF THE INVENTION

According to this invention, platinum is selected as a component of the electrode coating and, together with the platinum, tin, and optionally cobalt, are incorporated in the form of their oxide in the electrode coating in specified proportions. In the electrolysis of low concentration salt solutions such as sea water at low temperatures of less than about 20° C., the resulting electrode of this invention for use in electrolysis has superior durability. Further, the chlorine evolution potential does not suddenly approach the oxygen evolution potential with this electrode and the difference between the chlorine evolution and the oxygen evolution potential can be maintained at a large value.

While the chlorine evolution potential abruptly approaches the oxygen evolution potential in electrolysis at a low temperature and a low electrolyte concentration with conventional electrodes composed mainly of ruthenium oxide as a coating, with the electrode of this invention a large difference between these potentials can be maintained even under the above-described conditions, and therefore, oxygen evolution which is a side reaction and is undesirable can be prevented. Accordingly, by using the electrode of this invention, electrolysis can be performed in a stable manner over long periods of time even under these electrolysis conditions while a high efficiency of chlorine generation at relatively low electrolyzing voltages can be maintained.

The FIGURE specifically demonstrates this unique effect of this invention, and shows a comparison of the temperature and concentration dependences of typical electrodes obtained in the examples to be given hereinbelow with those of conventional electrodes. In the FIGURE, reference numeral 1 shows the curve for the chlorine evolution potential at varying temperatures when a saturated sodium chloride solution is electrolyzed using a conventional ruthenium oxide-type electrode having a coating composed of 45 mole % of ruthenium oxide and 55 mole % of titanium oxide; reference numeral 2 shows the curve of the oxygen evolution potential of a platinum/tin oxide type electrode of this invention obtained in Example 1; and reference numeral 3 shows the curve of the oxygen evolution potential of a platinum/tin oxide/cobalt oxide type electrode of this invention obtained in Example 5. Reference numerals 1', 2' and 3', respectively, designate curves of the chlorine evolution potentials of the above-described electrodes corresponding to reference numerals 1, 2 and 3 in an aqueous solution of sodium chloride at a low concentration (30 g of NaCl per liter). Reference numerals 1", 2" and 3" represent curves of the oxygen evolution potential of the above-described electrodes measured in an aqueous solution of $Na_2SO_4$ (100 g/liter; pH about 8.0). Reference numeral 4 represents the curve of the chlorine evolution potential of a conventional platinum-plated electrode measured in a saturated aqueous solution of sodium chloride. The chlorine evolution potential 4' in a low concentration sodium chloride aqueous solution and the oxygen evolution potential 4" measured in $Na_2SO_4$ are almost the same as the chlorine evolution potential 4.

It can be seen from the data given in the FIGURE that in the case of a Pt electrode, there is hardly any difference between the chlorine evolution potential and the oxygen evolution potential, and both of these potentials are high. Accordingly, in electrolysis with this Pt electrode, the efficiency of chlorine evolution is poor, and the electrolysis potential is quite high. With the conventional ruthenium oxide electrode, when the concentration of sodium chloride is high, the chlorine evolution potential (curve 1) does not abruptly rise even at low temperatures. However, when the concentration of the sodium chloride solution is low, the chlorine evolution potential (curve 1') abruptly closely approaches the oxygen evolution potential (curve 1") when the temperature of the electrolyte solution is below 15° C. Thus the oxygen evolution reaction becomes vigorous, and the the current efficiency in chlorine evolution is very greatly reduced. Furthermore, this reaction adversely affects the durability of the electrode and causes a decrease in the life of the electrode.

With the electrode of this invention, however, a rise in chlorine evolution potential is noted at low temperatures and low concentrations (curve 2', 3') but since the oxygen evolution potential is sufficiently high (curve 2", 3"), the difference between the oxygen evolution potential and the chlorine evolution potential can be maintained sufficiently large even under these conditions. Accordingly, the electrode of this invention has a high current efficiency of chlorine evolution and superior durability.

It is not entirely clear why the electrode of this invention exhibits such an effect. While not desiring to be bound, it is presumed, however, that by providing an electrode coating with platinum having good durability present therein substantially in metallic form and, combined with the platinum, tin oxide, or optionally cobalt oxide, the activity of the electrode is promoted, and the electrode is durable.

When the amount of platinum in the coating is less than 50 mole %, the amount of tin oxide exceeds 50 mole %, and, therefore, the electrode does not have sufficient corrosion resistance in electrolysis at low temperatures. On the other hand, when the amount of platinum exceeds 95 mole %, the resulting electrode exhibits properties close to those of a metallic platinum electrode. Therefore, the chlorine evolution potential at low electrolyte concentrations increases, and the amount of oxygen evolved increases as a result of a rise in electrolysis voltage. Accordingly, the amount of platinum which is suitable is 50 to 95 mole % and the amount of tin oxide which is suitable is 5 to 50 mole %. Addition of tin oxide in the amount specified prevents the rise in the chlorine evolution potential at low temperatures and low electrolyte concentrations.

If desired, up to 20 mole % of cobalt oxide may be present in the electrode coating of this invention. When the amount of cobalt oxide exceeds 20 mole %, the durability of the electrode is reduced. The addition of cobalt oxide in the amount specified achieves the effect of holding the volatilizable tin compound within the electrode coating and thus stabilizing the electrode coating.

The electrically conductive substrate which can be used in this invention is not particularly limited, and corrosion-resistant electrically conductive substrates of various known materials and shapes can be used. In the electrolysis of alkali metal halides such as an aqueous solution of sodium chloride, valve metals of which titanium is representative, other metals such as tantalum, niobium, zirconium and hafnium, and alloys composed mainly of these are suitable. Electrically conductive substrates obtained by coating such substances on other good electrically conducting materials such as copper or aluminum, or those substrates which are produced from the above-described substrates and an intermediate coating material (for example, a platinum-group metal, i.e., platinum, ruthenium, iridium, osmium, palladium or rhodium, or an alloy of the platinum-group metal) capable of increasing the corrosion resistance of the substrate or improving adhesion to the electrode coating can also be used.

Various known techniques can be employed in the formation of the electrode coating of this invention on such an electrically conductive substrate. The most suitable method is a thermal decomposition method which comprises coating a solution containing compounds of the coating ingredients on a clean substrate by using a brush or the like, and then heat-treating the coated substrate in an oxidizing atmosphere to convert these compounds to platinum metal and tin and cobalt oxides.

The coating solution of these compounds is preferably prepared by dissolving metal salts such as the chlorides, nitrates, organic salts, etc., of the individual platinum and tin as well as cobalt, if present, metal components in a solvent such as a mineral acid (e.g., hydrochloric acid) and/or an alcohol (e.g., ethyl alcohol, isopropyl alcohol, butyl alcohol, etc.). Chloroplatinic acid can be used as well. To improve the electrode characteristics, it is especially desirable in this invention to use a tin chloride such as $SnCl_2$ or $SnCl_4$ or a hydrated product thereof as the tin compound to be included in the coating solution for the formation of the tin oxide in the resulting electrode coating. Since such a tin chloride has a relatively high vapor pressure and is volatilazable (boiling point: 114° C. for $SnCl_4$, and 623° C. for $SnCl_2$), a very large amount of the tin component volatilizes during the step of coating an electrode by heat treatment. As a result, the surface of the electrode coating becomes roughened, and this is presumed to further impart the property of a low chlorine evolution potential to the resulting electrode.

Accordingly, the amount of the tin component in the coating solution should be larger than that required to obtain the required composition of the electrode coating when the tin component is a tin chloride. In the present invention, the amount of the tin component in the coating solution should desirably be about 10 to about 90 mole %. In the production of the electrode of this invention, about $\frac{1}{4}$ to $\frac{3}{4}$ of the tin in the coating solution is seen to volatilize.

The heat decomposition treatment needs to be carried out in an oxidizing atmosphere in order to sufficiently metallize and oxidize the compounds in the coating solution and to form a firm coating layer composed of platinum metal and tin and cobalt oxides. The oxygen partial pressure in the oxidizing atmosphere is preferably about 0.1 to about 0.5 atmosphere. Usually, heating in air suffices. The heating temperature is generally about 350° to about 650° C., preferably 450° to 550° C. A suitable heat treating time ranges from about 1 minute to about 1 hour. The heat treatment under these conditions results in the simultaneous imparting of electrochemical activity to the electrode coating.

The desired coating thickness can be easily obtained by repeating the application of the coating solution and the heat treatment of the coated substrate the desired number of times. In general a coating thickness of about 0.2 to about 10$\mu$, more preferably 0.5 to 3$\mu$ is suitable.

The following Examples are given to illustrate the present invention in greater detail. The invention, however, is not to be construed as limited to these Examples.

Unless otherwise indicated, all parts and percents are by weight.

EXAMPLES

The surface of a commercially available 3 mm-thick pure titanium plate was blasted with #3.0 alumina shot to remove adhering matter from the surface of the plate and roughen the surface of the plate. The titanium plate was then degreased with acetone, and washed with oxalic acid to form an electrode substrate.

Each of the coating layers having the various compositions in accordance with this invention described below were applied to the electrode substrate in the following manner.

Chloroplatinic acid (1 g as platinum) was dissolved in 40 ml of a 20% aqueous solution of hydrochloric acid, predetermined amounts of stannic chloride ($SnCl_4$) and cobalt chloride ($CoCl_2.2H_2O$) as set forth in Table 1 below, were added to the solution, and the mixture was stirred. Isopropyl alcohol was further added to form a coating solution having a volume of 50 ml.

The coating solution was applied to the titanium electrode substrate using a brush, dried at room temperature, and heated at 120° C. for 3 minutes to volatilize a part of the tin. Then, the coated layer was baked at 500° C. for 5 minutes in an oxidizing atmosphere having an oxygen partial pressure of 0.2 atmosphere and a nitrogen partial pressure of 0.8 atmosphere. This operation was repeated 30 times to form a coating having a thickness of about 1 micron on the electrode substrate.

The composition of the coating on the electrode substrate was measured by fluorescent X-ray analysis.

Table 1 summarizes the performances of the electrodes produced by this invention together with those of Reference Examples. The anode potential was measured by using a standard hydrogen electrode (NHE) as a reference under the following conditions.

(1) Chlorine Generation Potential—Measured in a saturated aqueous sodium chloride solution; 18° C.; Current density: 20 A/dm$^2$ (2) Chlorine Generation Voltage—Measured in a dilute aqueous sodium chloride solution (30 g NaCl/liter); 18° C.; Current density: 20 A/dm$^2$ (3) Oxygen Generation Potential—Measured in sodium sulfate solution (100 g $Na_2SO_4$/liter; pH=8.0; 18° C.; Current density: 20 A/dm$^2$.

The mechanical strength of the electrode was determined by detecting cracking or the degree of peeling of the electrode coating by a flexural test and an adhesive cellophane tape test.

It can be seen from the results shown in Table 1 and the Figure that the examples of the electrode in accordance with this invention have superior electrolysis characteristics at low temperatures and low electrolyte concentrations, and superior durability.

TABLE 1

| | Composition of Coating Solution (mole %) | | | Composition of Electrode Coating (mole %) | | | Anode Potential (V vs. NHE) | | | |
|---|---|---|---|---|---|---|---|---|---|---|
| | | | | | | | Saturated | Dilute | | |
| Sample No. | Pt | Sn | Co | Pt | Sn | Co | NaCl | NaCl | $Na_2SO_4$ | Mechanical Strength |
| Reference Example | | | | | | | | | | |
| 1 | 100 | — | — | 100 | — | — | 2.01 | 2.01 | 2.01 | Good |
| 2 | 98 | 2 | — | 99.5 | 0.5 | — | 1.37 | 1.90 | 2.01 | Good |
| 3 | 92 | 8 | — | 97.5 | 2.5 | — | 1.35 | 1.62 | 1.96 | Good |
| Example | | | | | | | | | | |
| 1 | 80 | 20 | — | 89 | 11 | — | 1.36 | 1.45 | 1.96 | Good |
| 2 | 60 | 40 | — | 88 | 12 | — | 1.35 | 1.42 | 1.94 | Good |
| 3 | 33 | 67 | — | 83 | 17 | — | 1.35 | 1.39 | 1.96 | Good |
| 4 | 15 | 85 | — | 78 | 22 | — | 1.36 | 1.42 | 1.92 | Good |
| Reference Example | | | | | | | | | | |

TABLE 1-continued

| Sample No. | Composition of Coating Solution (mole %) | | | Composition of Electrode Coating (mole %) | | | Anode Potential (V vs. NHE) | | | Mechanical Strength |
|---|---|---|---|---|---|---|---|---|---|---|
| | Pt | Sn | Co | Pt | Sn | Co | Saturated NaCl | Dilute NaCl | $Na_2SO_4$ | |
| 4 | 25 | 25 | 50 | 27 | 20 | 53 | 1.35 | 1.42 | 1.74 | Poor |
| 5 | 43 | 29 | 28 | 49 | 19 | 32 | 1.35 | 1.41 | 1.76 | Poor |
| 6 | 50 | 31 | 19 | 59 | 19 | 22 | 1.35 | 1.41 | 1.75 | Poor |
| Example | | | | | | | | | | |
| 5 | 54 | 30 | 16 | 63 | 18 | 19 | 1.35 | 1.42 | 1.75 | Good |
| 6 | 56 | 31 | 13 | 66 | 18 | 16 | 1.35 | 1.40 | 1.82 | Good |
| 7 | 59 | 32 | 9 | 70 | 19 | 11 | 1.35 | 1.40 | 1.82 | Good |
| 8 | 62 | 32 | 6 | 72 | 19 | 9 | 1.35 | 1.42 | 1.84 | Good |

While the invention has been described in detail and with reference to specific embodiments thereof, it will be apparent to one skilled in the art that various changes and modifications can be made therein without departing from the spirit and scope thereof.

What is claimed is:

1. An electrode for use in the electrolysis of an aqueous solution of a metal halide, said electrode comprising an electrically conductive substrate and, formed thereon, a coating comprising (1) 50 to 95 mole % of the platinum and (2) (a) 5 to 50 mole % of tin oxide, or (b) 5 to 50 mole % of tin oxide and cobalt oxide wherein the tin oxide is present in an amount of at least 5 mole % and the cobalt oxide is present in an amount up to 20 mole %, the total of (1) and (2) being 100 mole %.

2. The electrode of claim 1, wherein said coating consists essentially of said components (1) and (2).

* * * * *